United States Patent [19]

Krämer

[11] Patent Number: 4,668,213

[45] Date of Patent: May 26, 1987

[54] METHOD AND APPARATUS FOR CONTROLLING THE DIFFERENTIAL SPEED BETWEEN THE CENTRIFUGE DRUM AND THE SCREW CONVEYOR OF A WORM CENTRIFUGE

[75] Inventor: Paul Krämer, Cologne, Fed. Rep. of Germany

[73] Assignee: Klöckner-Humboldt-Deutz Aktiengesellschaft, Fed. Rep. of Germany

[21] Appl. No.: 822,030

[22] Filed: Jan. 24, 1986

[30] Foreign Application Priority Data

Jan. 24, 1985 [DE] Fed. Rep. of Germany ..... 3502252

[51] Int. Cl.[4] ..... B04B 13/00

[52] U.S. Cl. ..... 494/8; 494/9; 494/37; 494/53; 494/84

[58] Field of Search ..... 494/37, 7, 8, 9, 10, 494/52, 53, 54, 55, 84, 1

[56] References Cited

U.S. PATENT DOCUMENTS

| | | | |
|---|---|---|---|
| 4,073,431 | 2/1978 | Jager | 494/7 |
| 4,228,949 | 10/1980 | Jackson | 494/84 |
| 4,240,578 | 12/1980 | Jackson | 494/84 |
| 4,411,646 | 10/1983 | Cyphelly | 494/84 |
| 4,421,502 | 12/1983 | Jakobs | 494/7 |
| 4,432,747 | 2/1984 | Posse | 494/8 |

*Primary Examiner*—Robert W. Jenkins

[57] ABSTRACT

A method and apparatus for controlling a worm centrifuge wherein the centrifuge drum is driven by a first hydraulic motor and the screw conveyor is driven by a second hydraulic motor and first and second valves are connected to control the flow of hydraulic fluid to the motors and the valves receive the full output of a constant delivery pump. Control of the valves is obtained by a torque measuring device measuring the torque input to the screw conveyor and the torque measuring device has a control which opens the valve to a motor for the screw conveyor with increase in torque and simultaneously closes the valve to the motor to the centrifuged drum proportionately so that the total flow of the pump is utilized by the motors.

10 Claims, 5 Drawing Figures

CONTROL
MTR
MT'R.
VALVE
VALVE
PUMP
DRIVE
RESERVOIR
16
P
T
L
V-12
V-11

METHOD AND APPARATUS FOR CONTROLLING THE DIFFERENTIAL SPEED BETWEEN THE CENTRIFUGE DRUM AND THE SCREW CONVEYOR OF A WORM CENTRIFUGE

BACKGROUND OF THE INVENTION

The invention relates to an improvement in a method and apparatus for controlling the drive of a centrifuge drum, and more particularly to controlling the differential speed at which the screw conveyor and the drum of a worm centrifuge are driven.

A feature of the invention is the measurement of the torque input to the screw conveyor and controlling the flow of hydraulic fluid to the motors for the screw conveyor and worm centrifuge inversely by increasing the flow to the motor drive for the screw conveyor when the torque input is increased. The motors are driven by a constant output pump and the total output of the pump is constantly utilized.

In German OS No. 25 51 789 there is disclosed a solid bowl worm centrifuge wherein hydraulic motors are used to drive the conveyor screw and to drive the centrifuge drum. These hydraulic motors are connected to three pump units by pressure lines and the pump units are driven by a drive motor. The control of the speed differential between the centrifuge drum and the screw conveyor is obtained dependent on the torque of the screw conveyor and/or of the centrifuge drum by modifying or controlling the quantities of hydraulic fluid supplied to the hydraulic motors. The quantities are controlled by the use of control valves arranged in pressure lines from the pumps to the motors.

In accordance with this type of structure, all three pumps must be constantly in operation for controlling the speed differential between the centrifuge drum and the screw conveyor. This occurs even when only a part of the quantities of hydraulic fluid supplied by the pumps is required for the drive of the centrifuge and for maintaining the speed differential between the centrifuge drum and the screw conveyor. As a result of this structure and operation, it is a mandatory consequence that part of the quantities of hydraulic fluid conveyed by the pumps must be constantly conducted back into a pressure vessel and the energy is thereby lost for the drive of the worm centrifuge. This represents a relatively high energy loss which must be delivered by the drive motor of the pumps.

This known control of the speed differential between the centrifugal drum and the screw conveyor not only requires a high output for the pump units, for the pressure lines and other connections, but also involves high operating costs due to the energy losses. Further, the drive motor for the pumps must be designed appropriately powerful enough and must be designed beyond the power required for normal operation of the centrifuge, and therefore must be over dimensioned.

An object of the invention is to provide a method and structure which avoids the aforementioned disadvantages and operates at optimum load distribution to the screw conveyor and to the centrifuge drum and permits an infinitely variable and practially energy-free loss control of the speed differential between the drum and the screw in an improved and simplfied manner.

The foregoing objective is achieved by a unique process and apparatus wherein with increasing torque required to drive the screw conveyor, such as caused by increase in load or input to the centrifuge, the quantity of hydraulic fluid supplied to the hydraulic motor of the screw conveyor is increased via control valves. This increase is uniquely matched by a decrease in quantity of hydraulic fluid delivered to the hydraulic motor of the centrifuge drum. Similarly, the same proportional or ratio is maintained with decrease in torque required to drive the screw conveyor. That is, as the torque decreases, the amount of hydraulic fluid supplied to the hydraulic motor of the screw conveyor is decreased and accordingly the hydraulic fluid delivered to the hydraulic motor of the centrifuge drum is proportionately increased. Because of this method and the results of the apparatus provided, the energy exerted by the drive motor for the pump, and supplied to the hydraulic motors from the pump, can be fully exploited for maintaining the oepration of the worm centrifuge at a satisfactory level and for controlling the speed differential between the centrifugal drum and the screw conveyor.

In accordance with the invention, the drive of the drum and of the screw conveyor can be accomplished with an appreciable reduced energy outlay compared to previously known drive arrangements for worm centrifuges. This reduced energy outlay provides the advantage that the drive motor and conveying pump can be designed as smaller units and designed and constructed for operation at optimum efficiency thereby obtaining an appreciable reduction in energy requirement and an appreciable reduction in initial construction costs or cost of purchase to the plant in which the machinery is used.

In accordance with the principles of the invention, the sum of the quantities of hydraulic fluid supplied to the hydraulic motors is held constant. This is particularly expedient when the suspension to be dewatered by the centrifugal separator is a suspension having an essentially constant solid/fluid mixture.

Other objects, advantages and features will become more apparent with the teaching of the principles of the present invention in connection with the disclosure of the preferred embodiment in the specification, claims and drawings, in which:

DESCRIPTION

Figures 1, 2, 3, 4, 5:
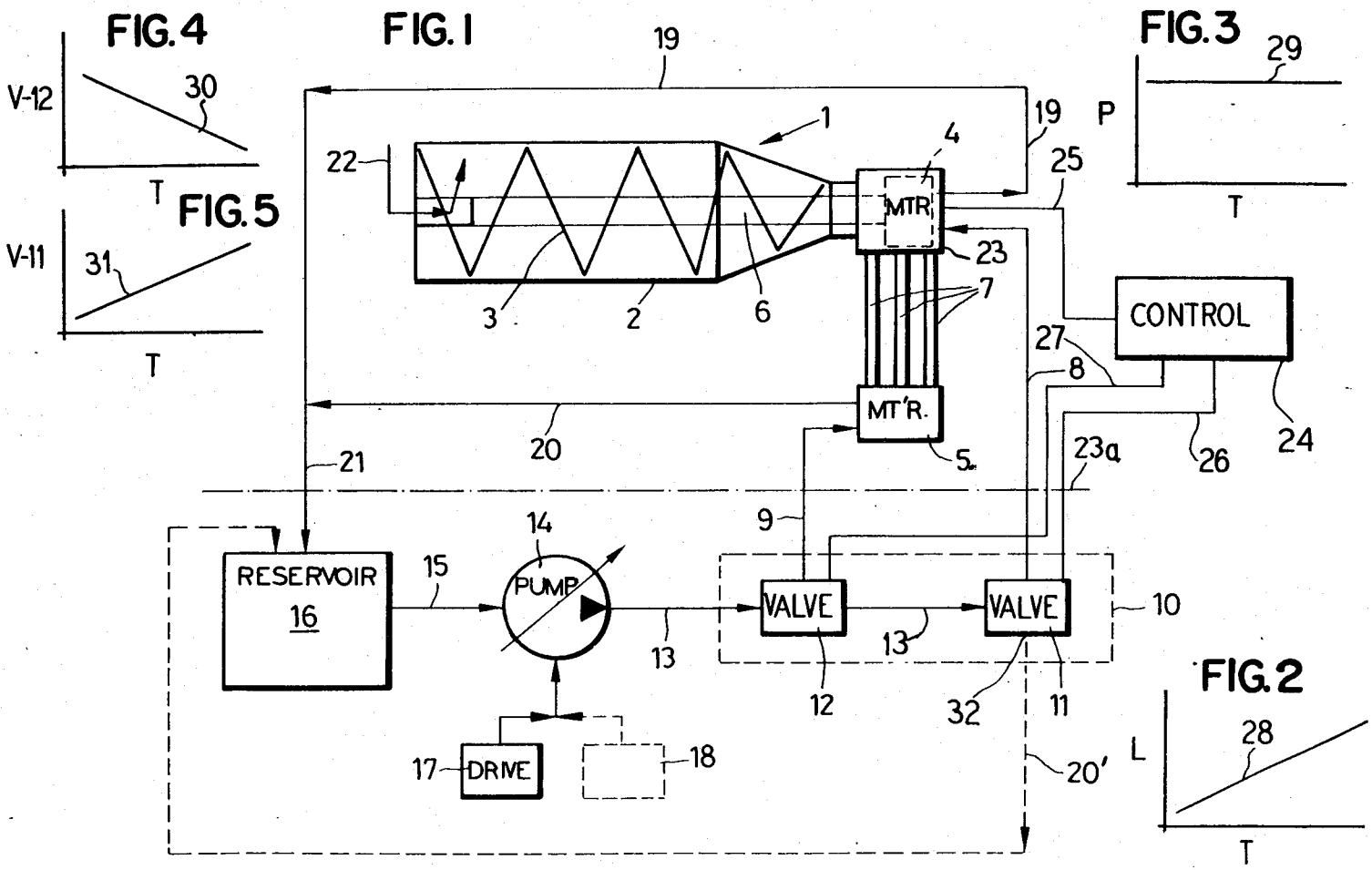
FIG. 1 is a diagrammatic illustration of the mechanism utilized in the preferred embodiment of the invention.
FIG. 2 is a schematic graph illustrating the relationship of torque input to the screw conveyor as a function of load on the screw on the centrifuge.
FIG. 3 is a schematic graph showing the relationship of pump output to torque input to the screw conveyor.
FIGS. 4 and 5 are schematic graphs illustrating the corresponding relationship of the opening of the valves to the drum motor and to the screw motor respectively relative to increase in driving torque to the screw conveyor.

As shown in FIG. 1, a worm centrifuge 1 includes a centrifuge drum 2 and a screw conveyor 3. These are respectively driven in independent rotation by hydraulic motors 4 and 5 with the motor 4 coupled to the worm shaft 6 of the screw conveyor. The hydraulic motor 5 is arranged on the frame of the centrifuge and drives the centrifuge drum 2 by V-belts 7. The worm motor 4 and the drum motor 5 are supplied by operating hydraulic fluid through hydraulic lines shown at 8 for the worm motor 4 and shown at 9 for the drum motor 5. Flow through these feeder lines 8 and 9 is controlled by a valve means including a valve 11 for the worm motor 4 and a valve 12 for the drum motor 5. These valves are located in a control block 10.

Preferably the control valves 11 and 12 are three-way valves wherein input to the valves is through a pressure line 13 which is directly connected to a hydraulic pump 14. In a preferred form, the pump 14 is an axial piston pump and has a constant output. Hydraulic input fluid for the pump 14 is obtained from a reservoir 16 through a suction line 15. The pump 14 is driven such as by an electric motor 17 or an internal combustion motor 18.

The hydraulic motors 4 and 5 have fluid discharge lines 19 and 20 for the spent operating hydraulic fluid which flows back to the reservoir 16 through a collecting line 21.

As illustrated in the drawing, only one hydraulic pump 14 is provided driven by the drive motors 17 or 18. The output of this hydraulic pump is divided into two feeder supply lines 8 and 9 for the hydraulic fluid and these lines are in communication with the input to the hydraulic motors 4 and 5 via control valves 11 and 12. The pump 14 is a positive displacement pump so that it has a constant output and all of its output must be delivered to the valves 11 and 12. That is, the sum of the flow to lines 8 and 9 equals the total output of the pump 14. Thus, when one valve 11 is opened, the other valve 12 is closed and vice versa and the total delivery of the pump 14 through the lines 13 is so arranged that the openings of the valves receives the full pump output flow.

For controlling the valves, the torque required to drive the hydraulic motor 4 for the worm is measured by a torque sensing device 23. The output signal from the torque device 23 is delivered to a proportional controller 24 by the connecting line 25. The proportional controller generates an output signal to control the opening of the valves 11 and 12 by connecting lines 26 and 17. In operation, as the torque measuring device 23 senses an increase in torque to drive the screw conveyor, the signal delivered to the proportional controller 24 causes a corresponding increase in signal to the valve 11 thereby opening the valve delivering an increased flow of operating driving hydraulic fluid to the screw control motor 4. Simultaneously, a reversed or inversion signal is delivered via the line 27 to the valve 12 to decrease the flow to the hydraulic motor 5 for the drum. The valves are operated so that their total opening is constant whereby in totality they receive the entire output of the pump 14. The operational relationship is illustrated further in FIGS. 2 through 5. The graph of FIG. 2 shows a curve whereby as the load on the screw conveyor increases, indicated by L, the torque T increases proportionately. This may not be a direct linear increase, but it can be best illustrated by showing a linear curve 28.

FIG. 3 shows the pump output at P relative to the torque T. As will be seen, the curve 29 illustrates a constant output volume from the pump 14 independent of change of torque.

As illustrated in FIGS. 4 and 5, the delivery through the valve 12, or in other words its opening, decreases with increase in torque. Simultaneously, the delivery through the valve 11, or in other words the opening of the valve 11, increases with increase in torque. The curves 30 and 31 may not be linear and are precalculated to obtain the desired speed relationship of the motors 4 and 5. However, the sum of the openings of the valves 11 and 12 and the sum of the volume of hydraulic fluid delivery to the lines 8 and 9 will always be constant at any one given torque so as to receive the totality of the constant flow delivery of the pump as shown in FIG. 3.

During operation of the worm centrifuge 1, the hydraulic motors 4 and 5 drive the screw conveyor and the centrifuge drum with a prescribed speed differential which is optimally adjusted to the solid/liquid mixture which is to be separated. The torque of the screw conveyor and/or of the centrifuge drum 2 is measured and monitored and the quantity of hydraulic fluid supplied to the motors 4 and 5 is varied dependent on the torque.

As shown on the drawing, the mixture which is to be separated is fed to the drum through an inlet line shown at 22 and the separated solids and liquids are discharged usually at the other end of the drum via suitable outlet openings and lines. In the event of an increase in solids content in the slurry to be dewatered, the speed differential between the centrifugal drum 2 and the screw conveyor 3 can be retained, increased, or even diminished very advantageously without special auxiliary pump units or the like. This will be attained by the control of the relationship between the curves 30 and 31 as set out by the proportional controller 24. As above stated, the curves 30 and 31 need not be linear but shaped so that the sum of the values at any given torque is equal to a constant.

When during the course of operating the worm centrifuge, the solids content of the solid/liquid mixture supplied to the centrifuge drum decreases, this has a corresponding influence on the torque by decreasing it. The control of the speed differential between the centrifuge drum 2 and screw conveyor 3 obtains inversely as a consequence of the diminishing torque of the screw conveyor. Then the quantity of hydraulic fluid supplied to the hydraulic motor 4 of the screw conveyor is reduced to a degree which corresponds to the diminishing torque and the quantity of hydraulic fluid supplied to the motor 5 is increased. The quantity of hydraulic fluid pumped by the pump 14 and delivered in totality to the motors 4 and 5 remains constant. An important advantage of this control of the speed differential resides in that the full energy exerted by the drive motor of the hydraulic pump, except of insignificantly low usual friction losses can be fully exploited for the drive of the worm centrifuge and for the control of the speed differential between the centrifuge drum 2 and screw conveyor 3. This effects a measurable reduction in operating costs in comparison with known drive systems.

In a direct manner and essentially without energy losses and optimum matching of the worm centrifuge operation to the respective solid/liquid measure can be obtained. With constant throughput power, the speed differential between the centrifuge and screw conveyor is increased or decreased while maintaining optimum separating results.

The method and structure of the invention also permits adaptation to a feed stock having extremely different and greatly fluctuating solids concentration. With an extremely lower solids concentration, a part of the hydraulic fluid will be discharged into the fluid reservoir 16 via the line 20'. With an extremely high solids concentration in the feed stock, the conveying power of the hydraulic pump is correspondingly increased by not discharging fluid back to the fluid reservoir via the line 20'. The hydraulic pump 14 is equipped for this type of operation with an output regulator which is not shown in detail, but which is provided at 32. In addition to the variable control of the speed differential obtainable, the basic speed of the centrifuge can also be correspondingly modified in a relatively simple way and the worm centrifuge optimumly adopted to the solids/liquid mixture to be separated.

On start-up, when the centrifuge drum of the screw conveyor is run up to the required operating speeds, the drive motor and the hydraulic pump must exert the corresponding acceleration energy and transmit such energy or power to the centrifuge. In order to accomplish this in a noncomplicated way, the hydraulic motor 5 driving the centrifuge drum is charged with the majority or all of the hydraulic fluid when the worm centrifuge is being run up to operating speed. This hydraulic fluid is conveyed by the hydraulic pump through the pressure line 13 via the control valve and the fluid feeder line 9. When the operating speed of the centrifuge has been reached, the centrifuge drum is charged with the solids/liquid mixture or suspension to be separated through the line 22, and on the basis of regulating curves, the quantity of hydraulic fluid supplied to the hydraulic motors is set, or in other words redistributed by operation of the control valves 11 and 12 such that the screw conveyor and the centrifuge drum rotate with speed differential that guarantees a disruption free solids discharge as well as optimum separation of the solids/liquid mixture. This is obtainable by the setting of the proportional controller, first to a start-up condition and then to a standard operating condition. The control of the speed differential between the drum 2 and the screw conveyor 3 automatically results in accordance with the relative control of the valves 11 and 12.

It is contemplated that the worm centrifuge 1 with the hydraulic motors 4 and 5 can be located in a gas-tight or pressure-tight compartment separated from the drive motors 17 or 18 and the hydraulic pump with the control block on the other side of a separating barrier 23*a*. 23*a* may designate a controlled compartment for the controls or for the centrifugal separator. In other words, the units located below the dot-dash line 23*a* in the drawing can be located in a dry or soundproof room separated from the worm centrifuge in a simple space saving way as a result of the possibility of providing a compact structure.

Thus it will be seen I have provided a method and apparatus which achieves the objectives above set forth and provides an advantageous control and drive for centrifugal separation.

I claim as my invention:

1. The method of controlling the speed differential between the centrifuge drum and the screw conveyor of a worm centrifuge with said drum and screw each driven by a hydraulic motor supplied with hydraulic fluid from a pump, comprising the steps:

measuring the torque input from the hydraulic motor driving the screw conveyor;

controlling the quantity of hydraulic fluid delivered from said pump to the motor for the screw conveyor and increasing the quantity as a function of increase in the torque input to the screw conveyor;

and controlling the quantity of hydraulic fluid directed to the motor for the drum and decreasing the amount delivered to the drum motor as a function of increase of torque input to the screw conveyor so that the output of the pump is optimized and the load increase evidenced by the torque increase to the screw conveyor is compensated for.

2. The method of controlling the speed differential between the centrifuge drum and the screw conveyor of a worm centrifuge with said drum and screw each driven by a separate hydraulic motor supplied with hydraulic fluid from a pump in accordance with the steps of claim 1:

wherein the sum of quantities of hydraulic fluid supplied to the hydraulic motors by the pump is held constant over a range of conditions.

3. The method of controlling the speed differential between the centrifuge drum and the screw conveyor of a worm centrifuge with said drum and screw each driven by a separate hydraulic motor supplied with hydraulic fluid from a pump in accordance with the steps of claim 1:

wherein the output of said hydraulic motor is constant over a range of operating conditions.

4. In a worm centrifuge, the combination comprising:

a rotatable centrifuge drum having a material inlet and a material outlet;

a screw conveyor rotatably mounted within the drum for independent rotation;

a first hydraulic motor connected to drive the drum at a speed proportional to the quantity of fluid delivered to the motor;

a second hydraulic motor connected to drive the screw at a speed proportional to the quantity of fluid delivered to said second motor;

a pump delivering a predetermined output quantity of hydraulic fluid;

valve means for controlling the flow of hydraulic fluid from the pump to said first and second hydraulic motors;

torque measuring means connected to measure the torque input to the screw conveyor;

and a control connected to said torque measuring means and to said valves increasing the flow of fluid to said second motor as a function of the increase of torque while correspondingly decreasing the flow of fluid to the first motor so that increase in load to the centrifuge is compensated by increased power directed to the screw conveyor.

5. In a worm centrifuge constructed in accordance with claim 4, the combination comprising:

said valve means including first and second valves;

a first hydraulic fluid feeder line connected between said first valve and said first hydraulic motor;

a second hydraulic feeder line connected between said second valve and said second hydraulic motor;

fluid delivery lines connected from the output of said pump to each of said valves so that as the opening of one valve is increased while the opening of the other valve is decreased the full output of the pump is received by the valves and delivered to said motors.

6. In a worm centrifuge constructed in accordance with claim 4:

wherein said hydraulic pump is an axial piston pump.

7. In a worm centrifuge constructed in accordance with claim 4:

wherein said hydraulic pump has an output regulator control connected to the output for maintaining a constant flow of hydraulic operating fluid to the valves.

8. In a worm centrifuge the combination comprising:

a rotatable centrifuge drum having a material inlet and a material outlet;

a screw conveyor rotatably mounted within the drum for independent rotation;

a first hydraulic motor connected to drive the drum at a speed proportional to the quantity of fluid delivered to the motor;

a second hydraulic motor connected to drive the screw at a speed proportional to the quantity of fluid delivered to said second motor;

a constant output pump for delivering a constant flow of hydraulic fluid to the valves;

a common line connected between the pump and the valves so that the entire total output of the pump is received by the valves;

individual lines between said first valve and said first motor and said second valve and said second motor;

a torque measuring means connected between the input motor for the screw conveyor and the screw conveyor for measuring the torque input and producing an output signal commensurate therewith;

a proportional controller connected to receive the output of the torque measuring means;

a first valve connected between the first hydraulic motor and the pump;

a second valve connected between the second hydraulic motor and the pump;

said proportional controller operative to simultaneously increase the opening of one valve while decreasing the opening of the other valve responsive to a change in signal from the torque measuring means;

a drive for the pump;

and a reservoir means for delivery of hydraulic fluid to the pump and for receiving spent hydraulic fluid from the first and second motors.

9. A control for a worm centrifuge having a centrifuge drum driven by a hydraulic motor and a screw conveyor within the drum driven by a hydraulic motor, the combination comprising:

first and second valve means respectively connected to the hydraulic motor for the drum and to the hydraulic motor for the screw conveyor;

a pump to deliver a predetermined constant total flow to said motors;

valve means connected between the pump and said motors for increasing flow to one motor while decreasing flow to the other motor so that the quantity of flow delivery to both motors is a constant sum;

means for measuring the torque input to the screw conveyor;

and a control operative responsive to the torque measuring means and connected to the valves respectively in inverse proportionality so that change in load to the centrifuge is compensated for by change in power to the screw conveyor.

10. In a worm centrifuge the combination comprising:

a rotatable centrifuge drum having a material inlet and a material outlet;

a screw conveyor rotatably mounted within the drum for independent rotation;

a first hydraulic motor connected to drive the drum at a speed proportional to the quantity of fluid delivered to the motor;

a second hydraulic motor connected to drive the screw at a speed proportional to the quantity of fluid delivered to said second motor;

a pump delivering a predetermined output quantity of hydraulic fluid;

valve means for controlling the flow of hydraulic fluid from the pump to said first and second hydraulic motors;

torque measuring means connected to measure the torque input from a motor to one of said drum and screw members;

and a control connected to the measuring means and said valves changing the flow of fluid to the motors as a function of change in torque so that the total fluid output flow to the motors remains constant to change the drive relationship between said motors and compensate for change in load to the centrifuge.

* * * * *